US007207072B2

(12) United States Patent
Halsnes et al.

(10) Patent No.: US 7,207,072 B2
(45) Date of Patent: Apr. 24, 2007

(54) HELMET

(75) Inventors: Odd Halsnes, Båstad (NO); Knut H. Aas, Elverum (NO); Rune Lausund, Skedsmokorset (NO)

(73) Assignee: Forsvarets Forskningsinstitutt (NO)

( * ) Notice: Subject to any disclaimer, the term of this patent is extended or adjusted under 35 U.S.C. 154(b) by 0 days.

(21) Appl. No.: 10/533,117

(22) PCT Filed: Oct. 28, 2003

(86) PCT No.: PCT/NO03/00357

§ 371 (c)(1),
(2), (4) Date: Apr. 29, 2005

(87) PCT Pub. No.: WO2004/040227

PCT Pub. Date: May 13, 2004

(65) Prior Publication Data

US 2006/0000010 A1 Jan. 5, 2006

(30) Foreign Application Priority Data

Oct. 31, 2002 (NO) ..... 20025230

(51) Int. Cl.
*A42B 1/08* (2006.01)

(52) U.S. Cl. ..... 2/424; 2/6.3; 2/6.5

(58) Field of Classification Search ..... 2/424, 2/425, 6.3, 6.5, 10; D2/891; D29/104, 105, D29/106, 107, 110
See application file for complete search history.

(56) References Cited

U.S. PATENT DOCUMENTS

D228,323 S * 9/1973 MacCoon ..... D29/107
4,769,857 A * 9/1988 Cianfanelli et al. ..... 2/424
5,056,156 A * 10/1991 Kosmo et al. ..... 2/411
5,113,535 A 5/1992 Hedges
5,283,914 A 2/1994 James
6,226,803 B1 * 5/2001 Tanaka ..... 2/424
6,237,161 B1 5/2001 Lee (Continued)

FOREIGN PATENT DOCUMENTS

WO WO-0060970 10/2000

*Primary Examiner*—Rodney Lindsey
(74) *Attorney, Agent, or Firm*—Connolly Bove Lodge & Hutz, LLP; Larry J. Hume

(57) ABSTRACT

The present invention relates to a helmet and a basic helmet concept with highly flexible construction of use in a number of different situations. The helmet can provide varying degrees of protection and can very easily alternate between the various forms of protection. In addition the individual parts of the helmet can easily be replaced. The helmet consists of an outer helmet with a head-protecting part (1) which essentially covers the side, top and back of the head, a chin guard (39 in front of the lower part of the face and a transparent visor (2) which covers the field of vision of the person using the helmet, together with an inner helmet which is connected to the outer helmet and which inner helmet abuts against the user's head. The helmet is characterised in that the two elements—chin guard (3) and visor (2) are pivotably connected concentrically about a point (D) on each side of the head-protecting part, with the result that the visor (2) moves within the inside of the head-protecting part (1) of the helmet and the chin-protecting part (3) of the helmet moves within the visor (2).

6 Claims, 5 Drawing Sheets

U.S. PATENT DOCUMENTS 6,282,726 B1 9/2001 Noyerie
6,438,763 B2 * 8/2002 Guay et al. ..... 2/424
2003/0182716 A1 * 10/2003 Wu ..... 2/424

* cited by examiner

HELMET

CROSS REFERENCE TO RELATED APPLICATIONS

This application is a U.S. National Stage entry under 35 U.S.C. § 371 of co-pending International Patent Application No. PCT/NO2003/000357, filed on Oct. 28, 2003 by HALSNES, Odd et al. entitled HELMET, the entire contents of which is incorporated by reference. As in the parent International Application No. PCT/NO2003/000357, priority is also claimed to Norway Patent Application No. 20025230, filed on Oct. 31, 2002, the entire contents of which is incorporated by reference and for which priority is claimed under 35 U.S.C. § 119.

BACKGROUND

The present invention relates to a helmet and a basic helmet concept with highly flexible construction for use in a number of different situations. The helmet can provide varying degrees of protection and can very easily alternate between the various forms of protection. In addition the individual parts of the helmet can easily be replaced.

Helmets are commonly known in the form of full-face helmets and half-face helmets, the difference between them being that the full-face helmet has additional protection of the area around the mouth and chin. The half-face helmet on the other hand protects only the sides and top of the head as well as to some extent the forehead and nape of the neck depending on its shape and size.

Furthermore, both full-face and half-face helmets may have a transparent visor for protecting the eyes and the face/head in the area round the eyes while at the same time permitting the person using the helmet to retain the ability to see.

In many cases it may be desirable not to employ the visor in order to avoid spoiling the visual experience. It may be necessary, moreover, to sometimes keep the visor in an open condition (completely or partly) in order to ensure satisfactory replacement of air in the interior of the helmet or to regulate the temperature, etc.

In many cases, however, it is desirable to be able to choose the degree of protection depending on whatever situation might arise. In such cases it is desirable to be able to choose between full-face and half-face helmet with and without visor in various combinations. In principle this calls for a helmet consisting of at least three parts that can be used in various combinations. These parts are, the actual head protection, chin protection (which also covers the mouth etc.) and a visor covering the field of vision.

In this connection various solutions are known where, for example, a loose chin guard is pivotably attached to the outside of the actual head protector, thus enabling the chin guard to be pivoted up over the head protector (often employed by motorcycle police). This may be combined with the visor. The drawback with this solution is that the chin guard has to be relatively large since its interior has to be capable of being passed over the outside of the actual head protector. In most cases, moreover, the helmet is not spherical in shape, with the result that the pivot point has to be located sufficiently high up on the side of the helmet to enable the chin guard to be moved between an inactive position over the helmet and an active position in front of the chin/mouth. This will always be a compromise and the solution has a number of disadvantages with regard to design and safety in addition to being expensive and complicated. Furthermore, the chin guard is extremely exposed to wind and weather in the inactive position and sealing between visor and helmet is difficult to achieve both at the upper and lower edges.

Helmets also exist with a releasable chin guard which is mounted in clip-like holders when required. These holders may, for example, be permanently fixed on each side of the helmet. The drawback in this case is that a loose chin guard has to be brought along separately.

There also exist various kinds of half-face helmet with and without visor. In these solutions the visor can be pivoted between an active and inactive position in front of the face or away from the face respectively. The pivot points are often on the side of the helmet and the visor is pivoted up on the outside of the helmet.

Prior art solutions are documented in U.S. Pat. No. 6,237,161 where a helmet with a head protecting part, a chin guard and a visor is disclosed, where the chin guard and the visor are individually pivotably connected about a point on each side of the head protecting part. The chin guard however moves on the same level as the visor.

In U.S. Pat. No. 5,283,914 a helmet is described with no chin guard and the visor is slidably and pivotably connected on supports on each side of the head protecting part.

In WO 00/60970 a helmet is disclosed also without the chin guard but with a visor pivotably connected and moving on the inside of the head protecting part.

Furthermore in U.S. Pat. No. 6,282,726 is described with a head protecting part and two visors individually connected about respective points on each side of the head protecting part.

Also U.S. Pat. No. 5,113,535 describes a helmet with a head protecting part with two visors pivotably connected on each side of the helmet, where the visors move on the outside of the head protecting part.

In many cases the police, military or civil security workers in particular require a helmet that can easily alternate between the protection offered by a full-face helmet with a visor and the security offered by a half-face helmet with or without a visor. This is required without loose parts so that the options are always available without further logistics. Furthermore, it is desirable to be able to pull down each individual element of the visor or chin guard individually. It is also desirable to be able to tighten and adjust the pivotable suspension in a simple manner and to be able to replace the individual parts quickly and easily. A helmet according to the above will be highly versatile and useful. It will also be possible to employ such a helmet in a number of civil situations in connection with sport and leisure activity, driving motorcycles or the like.

Depending on the area of application, it will be appropriate to employ various inner helmets or shock-absorbing "padding" on the inside of the helmet abutting the user's head. It is therefore desirable that a helmet as indicated above should be in the form of an outer helmet employed with an inner helmet according to requirements.

It is therefore an object to provide a helmet that satisfies the above requirements. Such a helmet should be capable of offering a head-protecting part with pivotably connected chin guard and visor, which helmet can be provided on different kinds of inner helmets and "padding" or linings abutting the user's head.

SUMMARY

According to the present invention, therefore, a helmet is provided consisting of an outer helmet with a head-protecting part which substantially covers the side, top and back of the head, a chin guard in front of the lower part of the face and a transparent visor that covers the field of vision of the person using the helmet, together with an inner helmet that is connected to the outer helmet, which inner helmet abuts against the user's head. The helmet is characterised in that the two elements—chin guard and visor—are pivotably connected about a point on each side of the head-protecting part with the result that the visor moves within the inside of the head-protecting part of the helmet and the chin-protecting part of the helmet moves within the visor. Thus the visor and the chin guard are moved according to a roof tile principle where the bottom part (the chin guard) is located furthest in. This ensures that rain water etc. can easily flow over the outside of the helmet. It is also possible to design the various parts of the helmet in this manner so as to provide an exterior without external parts (or with a minimum thereof) which can become tangled or be damaged.

Furthermore, in the preferred embodiment a clutch mechanism is installed between the visor and the chin guard, thus permitting individual movement of neck protector and visor about the pivot point on the head-protecting part of the helmet. It is thereby possible to pull down the visor and the chin guard individually in any order. An embodiment of such a clutch is a plate mounted between the visor and the chin guard at the mounting point on each side of the helmet, which plate is fixed relative to the rotational motion. This may be implemented in several ways, either by fixing it to the attachment point or attaching it in some other fashion to the helmet's head-protecting part. Both the visor and the chin guard will thereby be able to move individually without influencing the other of the two elements. This of course depends on the two parts fitting together correctly in other respects so that they do not touch each other when moving.

In a further embodiment the chin guard and visor are pivotably connected concentrically about a point on each side of the head-protecting part.

In a further embodiment, stoppers may be provided on the clutch plate or on the inside of the helmet to limit the travel or rotational motion of the visor and the chin guard so that they only travel between predefined extreme points. This will prevent the visor from moving down towards the chin etc. Since the visor and the chin guard move on each side of the clutch plate, a stopper is provided on each side for engagement with the visor (on the outside against the helmet's head-protecting part) and engagement with the chin guard (on the inside against the interior of the helmet) respectively. Furthermore, on the visor and the chin guard in the area of the rotational suspension on each side of the helmet there are provided grooves or countersinkings which engage with each of the stoppers on the clutch plate.

The pivot point and the attachment point for the visor and the chin guard are, for example, a bolt, lug, pin or the like which are through-going or attached to the interior of the helmet, with a self-locking nut that keeps the helmet, the visor and the chin guard together. In an embodiment, the nut may be in the form of a large wheel which enables a person to operate the nut with his hands in order to adjust the mechanism or to replace parts of the mechanism or the helmet such as a broken visor or the like. It is also possible to employ friction-generating discs between the clutch plate and the visor and the chin guard for regulation of the resistance that has to be overcome in order to move the visor and the chin guard. Such friction discs are regulated substantially by tightening or slackening the connection holding (clamping) the parts together about the axis of rotation, which in a number of embodiments will be the self-locking nut.

In yet another embodiment the nut may be provided with depressions or projections which are either elastic or engage with an elastic element which restricts the nut's free rotation. This prevents inadvertent movement of the mechanism.

In a further embodiment, on the inside in the front edge of the head-protecting part, there is provided a bar or strip which abuts flexibly against the outside of the visor. Thus when the visor is moved up or down inside the head-protecting part of the helmet, the outside is wiped clean of water or the like in the manner of a windscreen wiper.

Furthermore, in different embodiments sealing elements may be provided between the visor and the helmet as well as between the chin guard and the visor in order to prevent the penetration of moisture and dust. Thus with the visor and chin guard pulled down, the helmet will provide good protection against dust, rain, etc.

In an embodiment the helmet's head-protecting part has a partial spherical shape and the visor and chin guard match this spherical shape possibly with adaptation of size to enable them to be moved on the inside of the helmet. In further alternative embodiments the visor and the chin guard can be moved within an outer layer of the helmet. This may be necessary in order to achieve the required degree of protection, for optimal exploitation of materials or for expedient positioning of the movable parts relative to, e.g., the attachment for the inner helmet. In this case the helmet's head-protecting part can be constructed as a two-layered helmet structure over the whole or parts of the helmet's head-protecting part.

In a further preferred embodiment, moreover, the visor and the chin guard have matching shapes, thus achieving maximum protection of the chin and the lower part of the head, while ensuring a good view from the visor. In such embodiments the central part of the chin guard at the mouth/nose is generally pulled up so as to cover the nose. Furthermore, the visor covers each side of the raised portion at nose and mouth in order to ensure a good view downwards.

For military use an outer shell is required for the helmet, preferably combined with extra camouflage measures, and both for military and other use, e.g. fire/rescue, it may be appropriate to affix/integrate in the outer shell light sources, a camera, night/low light aids, communication means, etc.

DESCRIPTION OF THE DRAWINGS

In the attached figures, moreover, an example is illustrated of a helmet according to the present invention.

DETAILED DESCRIPTION

In FIGS. 1, 2, 3 and 4 a helmet is illustrated according to the present invention, which helmet comprises a head-protecting part 1 which covers the top, sides and back of the head. The helmet further comprises a visor 2 and a chin-protecting part 3, both of which are pivotable concentrically about a pivot point on each side of the helmet. The visor 2 is also provided with a lug, on each side which makes it easier for the user of the helmet to get hold of the visor when it is pushed up into the interior of the helmet. Similar lugs may easily be placed on the chin-protecting part.

As will be apparent in the figures, both the visor and the chin guard can be moved individually up and down independently of each other according to a "roof tile" principle, i.e. the chin guard moves into the visor which in turn moves into the helmet's head-protecting part. Water etc. from above will thereby flow over the outside of all the parts of the helmet.

Figure 1:
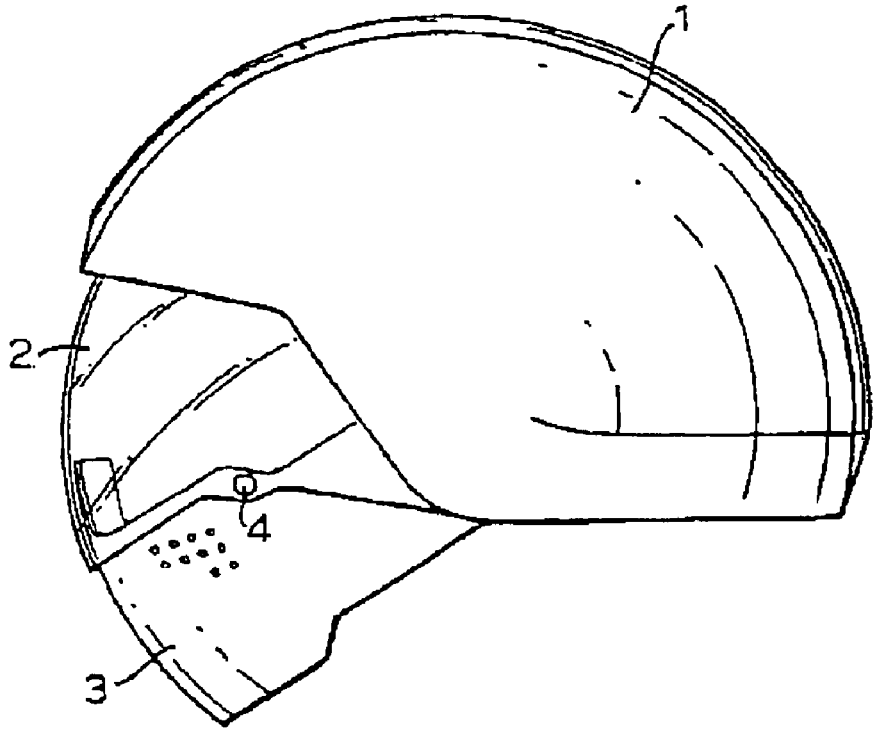
FIG. 1 is a side view of a helmet according to the present invention.
Figure 2:
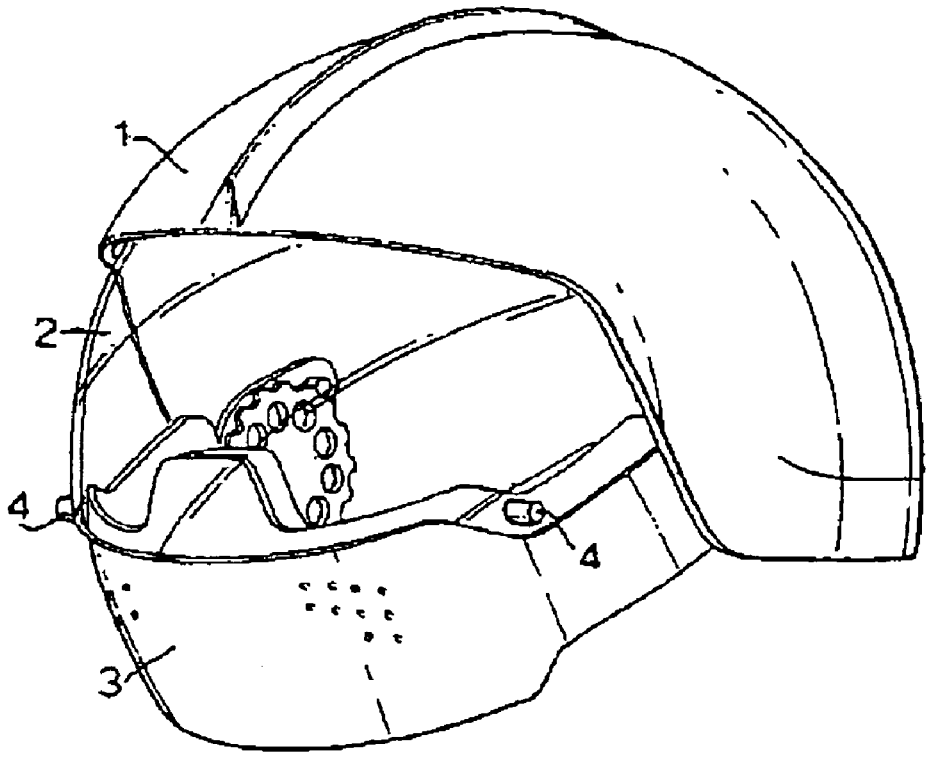
FIG. 2 is a perspective view of the helmet illustrated in FIG. 1.
Figure 3:
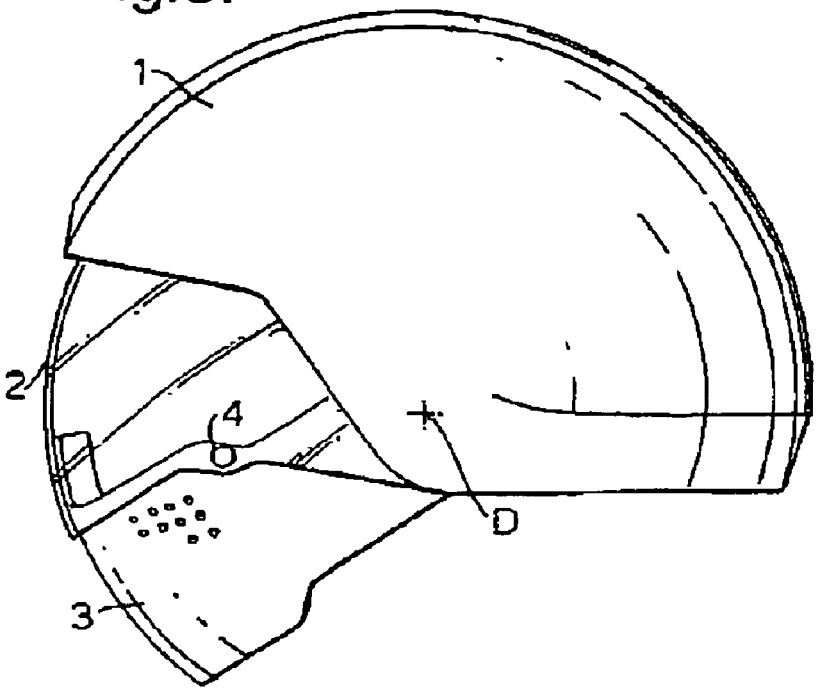
FIG. 3 is an illustrated side view of the helmet depicted in FIGS. 1 and 2.
Figure 4:
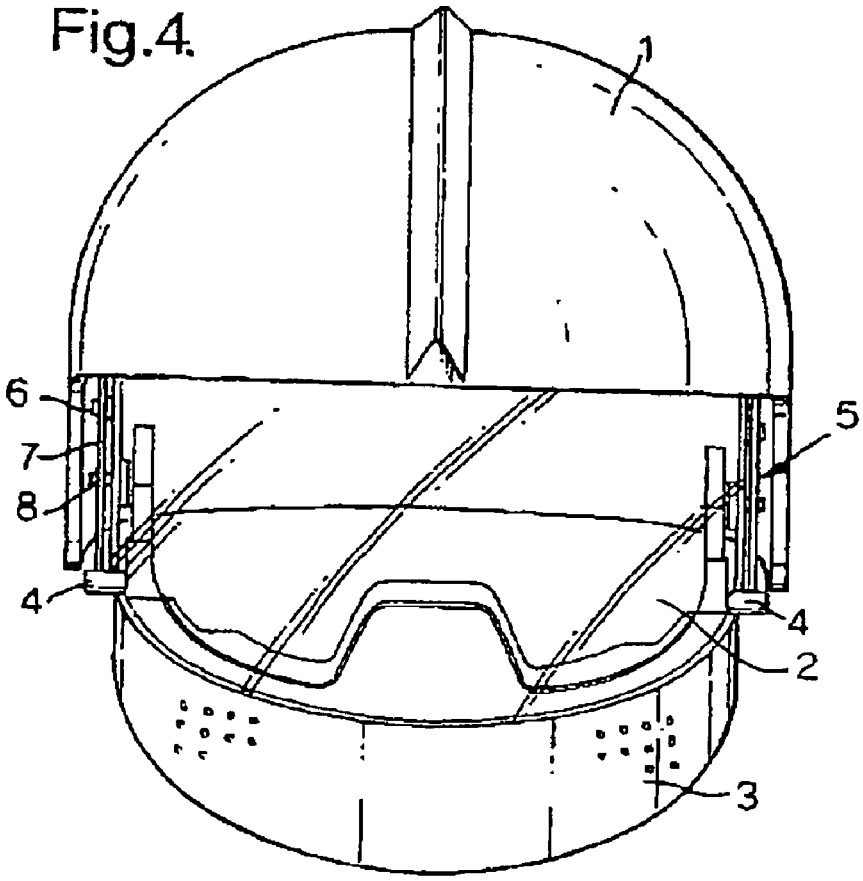
FIG. 4 is a front view of the helmet in the preceding figures.

In FIG. 4 there is further illustrated a preferred clutch mechanism 5 at each pivot point for the visor 2 and the chin guard 3. The clutch mechanism illustrated consists essentially of a plate 7 with lugs 6 and 8 which control the movement, i.e. upper and lower limits for the visor 2 and the chin guard 3 respectively. The construction of the pivot point is not illustrated in greater detail, but this is evident from the description above. Various other kinds of clutch mechanisms that permit individual rotation may of course also be employed.

Figure 5:
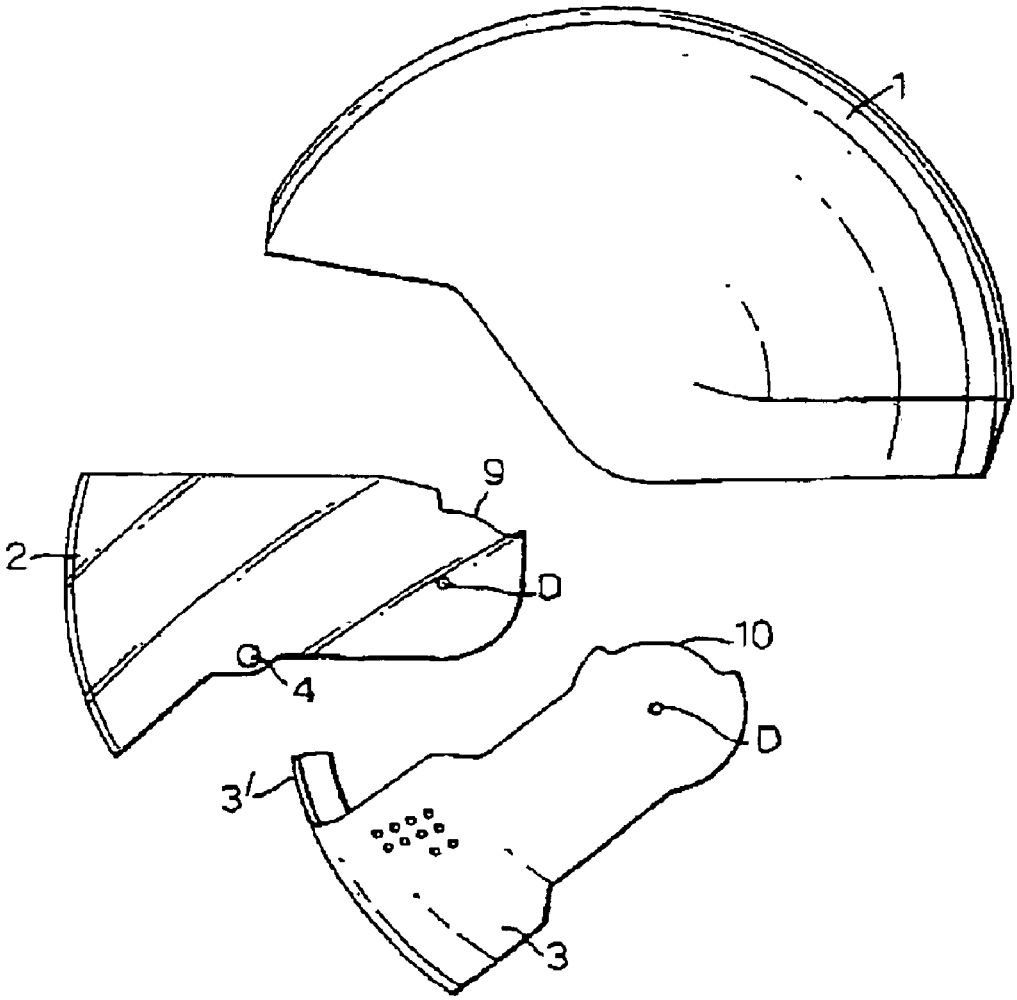
FIG. 5 is an exploded view of the different parts of the helmet.

FIG. 5 further illustrates in exploded form how the helmet's various parts can be designed. Here the helmet's head-covering part 1, the visor 2 and the chin-protecting part 3 with the raised portion at the nose/mouth 3' are illustrated as indicated above.

The lug 4 on the visor is also indicated. The pivot point in each of the pivotably mounted parts is further indicated by D. Furthermore, sections 9 and 10 are illustrated where the lugs (6 and 8 respectively) are engaged in order to control the rotational motion's extreme points.

Figure 6:
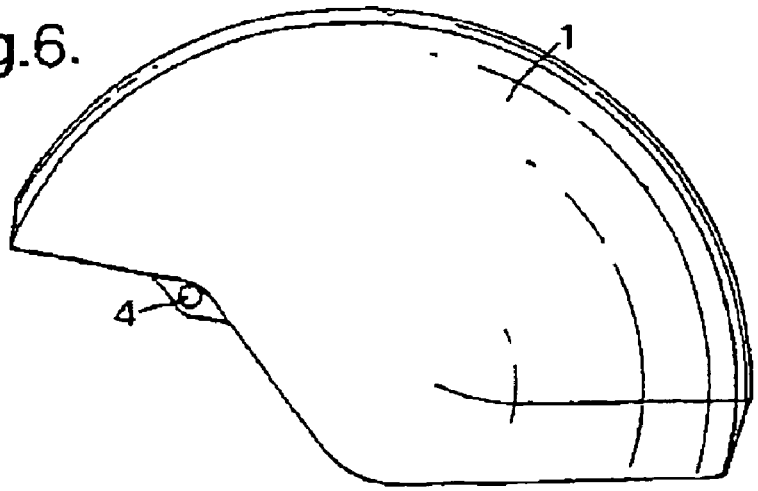
FIGS. 6, 7 and 8 illustrate a helmet according to the present invention in various positions of use.
Figure 7:
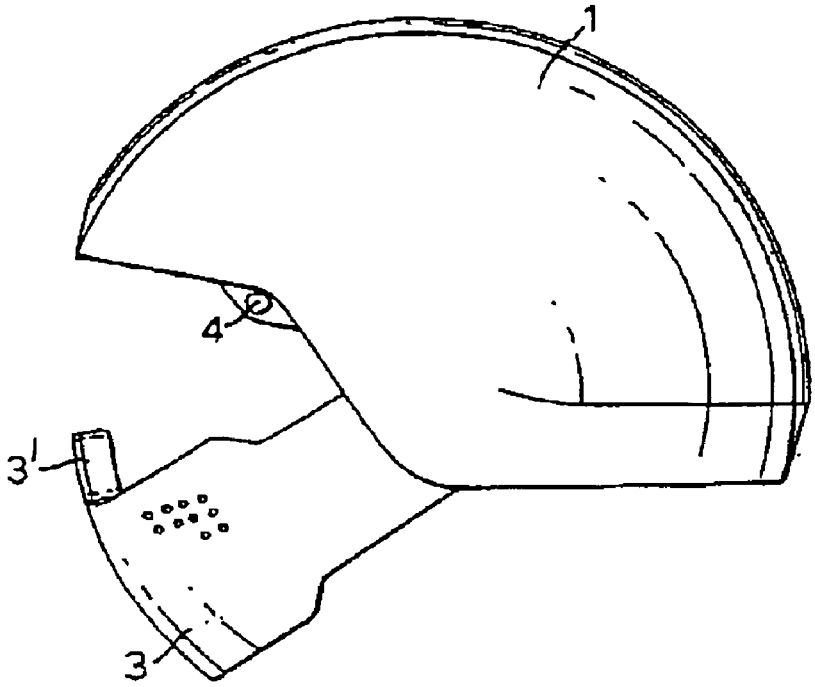

FIGS. 6 and 7 illustrate different combinations of the various parts of the helmet. As can be seen, both visor and chin guard are pushed into the helmet. The chin guard 3 can be folded down alone or together with the visor 2. The visor 2 may also be folded down on its own (not shown).

Figure 8:
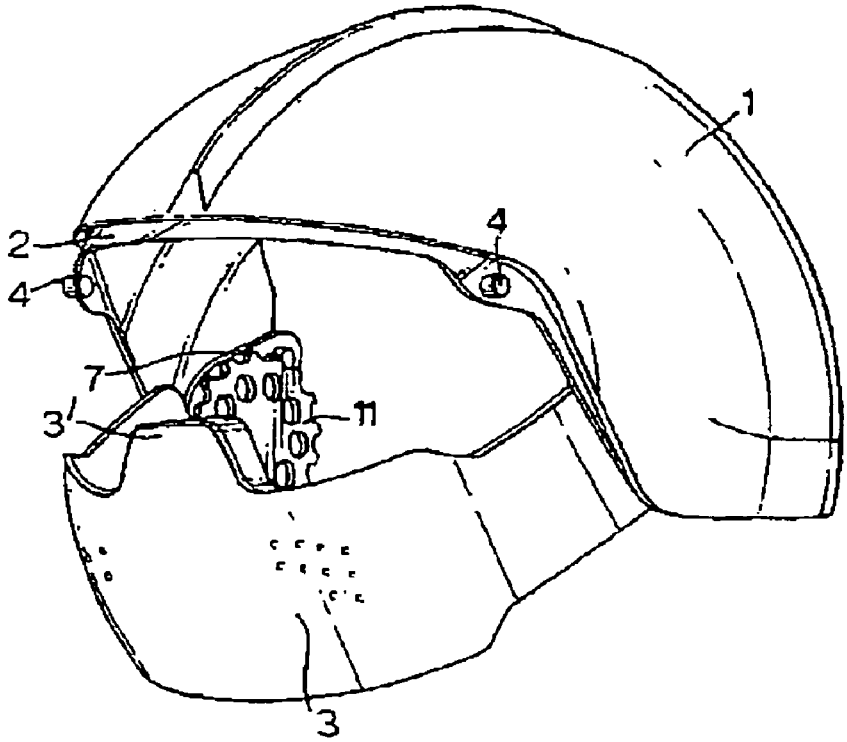
Figure 9:
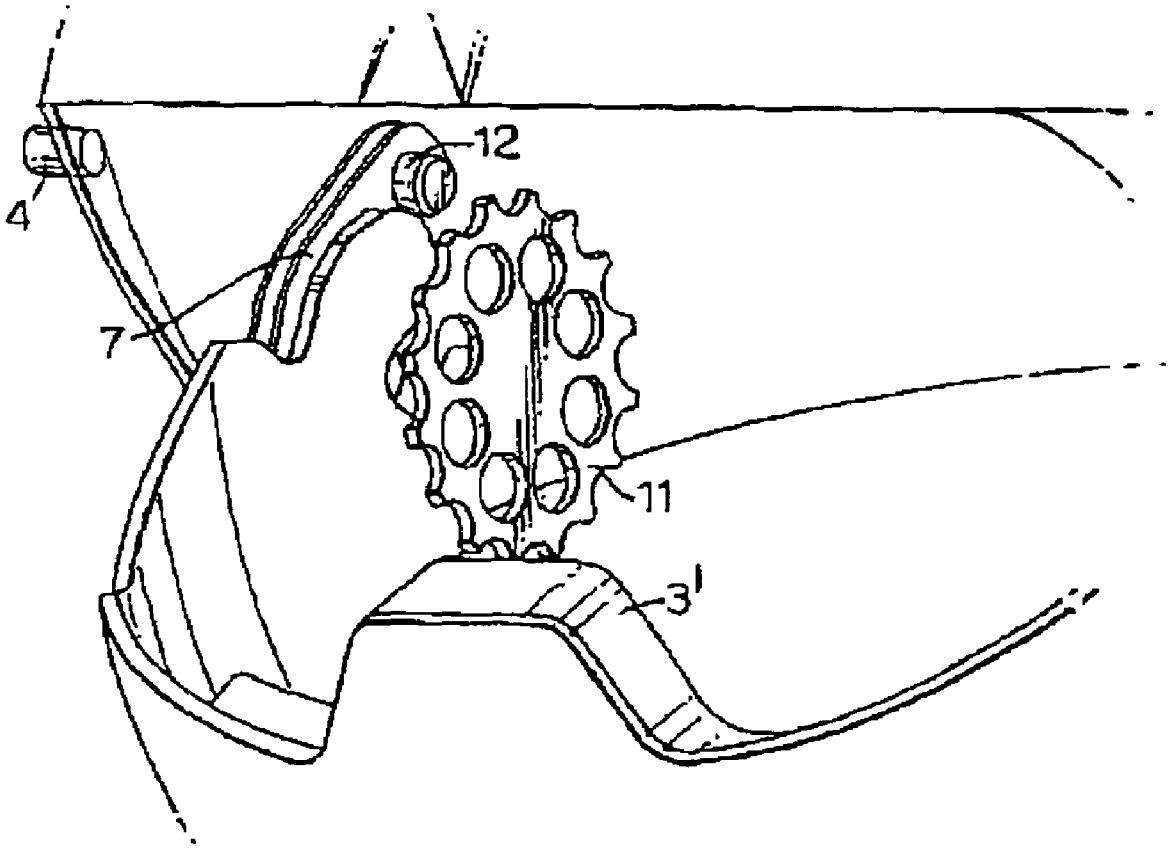
FIG. 9 illustrates details of the helmet depicted in the preceding figures.

In FIGS. 8 and 9, moreover, an embodiment is illustrated of the self-locking nut 11 or other locking/tightening device for the rotational connection between the helmet's various parts. The outer edge of the nut 11 is further restricted by the lug 12 on the clutch.

Various other embodiment of a clutch etc. may of course be employed without departing from the inventive concept indicated in the following patent claims.

The attachment points for the inner helmet are not further specified, but they will be retracted to prevent them from coming into conflict with the visor and the chin guard when they are pushed up.

The invention claimed is:

1. A helmet suitable for wearing on a head of a user, the helmet comprising:

an outer helmet with a head-protection part which essentially covers a side, top and back of the head; and a chin guard in front of a lower part of a face of the user and a transparent visor which covers a field of vision of the user;

wherein said chin guard and said visor are individually pivotably connected about a pivot point on each side of the head-protection part, said visor moving within an inside portion of the head protection part of the helmet and said chin guard moving within the visor.

2. A helmet according to claim 1, wherein at the visor and chin guard, a clutch mechanism is provided which permits individual movement of said chin guard and visor about the pivot point on the head-protection part of the helmet.

3. A helmet according to claim 2, wherein the pivot point and an attachment point for the visor and the chin guard comprises a bolt connection with a self locking nut.

4. A helmet according to claim 1, wherein the pivot point and an attachment point for the visor and the chin guard comprises a bolt connection with a self locking nut.

5. A helmet according to claim 1, wherein an inside portion along a front edge of the head-protecting part flexibly abuts against an outside portion of the visor.

6. A helmet according to claim 1, wherein said chin guard and visor are individually pivotably connected concentrically about a pivot point on each side of the head-protection part.

* * * * *